United States Patent [19]

Olofsson

[11] 4,201,523

[45] May 6, 1980

[54] DEVICE FOR COOLING AND SILENCING OF NOISE OF A COMPRESSOR OR VACUUM PUMP

[76] Inventor: Björn O. E. Olofsson, Åkervägen 6, S-190 40 Rosersberg, Sweden

[21] Appl. No.: 871,552

[22] Filed: Jan. 23, 1978

[51] Int. Cl.[2] ..... F04B 39/00; F04B 39/06

[52] U.S. Cl. ..... 417/312; 417/313; 417/372

[58] Field of Search ..... 417/312, 313, 372, 367, 417/307

[56] References Cited

U.S. PATENT DOCUMENTS

| | | | |
|---|---|---|---|
| 1,927,213 | 9/1933 | MacKenzie et al. | 417/312 |
| 2,229,119 | 1/1941 | Nichols et al. | 417/312 |
| 2,734,459 | 2/1956 | Zimsky . | |
| 2,840,180 | 6/1958 | Nobles et al. | 417/312 X |
| 2,961,149 | 11/1960 | Hull | 417/312 |
| 3,426,691 | 2/1969 | Anderson . | |
| 3,746,477 | 7/1973 | Ozu et al. | 417/372 |
| 3,785,167 | 1/1974 | Sahs | 417/312 X |
| 3,813,187 | 5/1974 | Winter | 417/310 X |

FOREIGN PATENT DOCUMENTS

| | | | |
|---|---|---|---|
| 1962667 | 7/1970 | Fed. Rep. of Germany | 417/312 |

*Primary Examiner*—Carlton R. Croyle
*Assistant Examiner*—Edward Look
*Attorney, Agent, or Firm*—Lawrence E. Laubscher

[57] ABSTRACT

A device is described for cooling and silencing a compressor or vacuum pump which is directly connected to an electric driving motor. Both the compressor and the driving motor can be immersed, and are arranged in a totally sealed container encasing a cooling and sound-absorbing liquid to such a level that the compressor or vacuum pump and driving motor are totally immersed in the liquid. The whole of the outer surface of the container is coated with sound-absorbing material, and at least one heat exchanger is arranged outside the container and the sound-absorbing material, the heat exchanger being in communication with the inside of the container so that the cooling and sound-absorbing liquid flows through the heat exchanger under the influence of the thermal circulation generated in the liquid.

5 Claims, 1 Drawing Figure

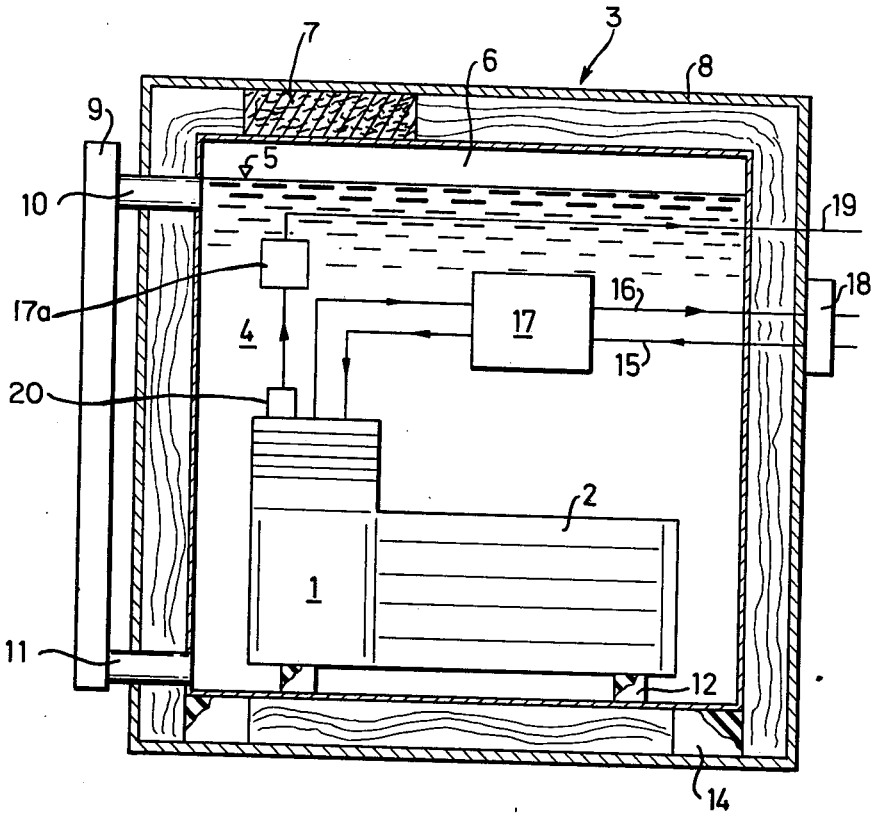
3
7
6
8
9
5
10
19
17a
16
18
17
4
15
20
2
1
11
12
14

DEVICE FOR COOLING AND SILENCING OF NOISE OF A COMPRESSOR OR VACUUM PUMP

BRIEF DESCRIPTION OF THE PRIOR ART

The present invention relates to a device for cooling and silencing of noise of a compressor or vacuum pump.

During operation of compressors or vacuum pumps, large quantities of heat are generated during compression and transport of the medium, and a compressor or vacuum pump must therefore be provided with an effective system for cooling of the compressor or pump and possibly also the medium after the same has been compressed.

During the operation of compressors or vacuum pumps, whether they are of the membrane, piston, or screw type, irritating noise is also involved, which in many cases constitutes a serious environment problem.

SUMMARY OF THE INVENTION

The object of the present invention is to provide an effective system for cooling of a compressor or vacuum pump, ssaid system at the same time providing superior silencing of the noise produced during operation of the compressor or vacuum pump.

The invention is furthermore intended to make possible for at least part of the large quantity of heat produced during operation of the compressor or vacuum pump to be used for the heating of premises or the like, e.g. the room in which the compressor or vacuum pump is installed.

Another aspect of the invention is to isolate the compressor or vacuum pump together with the cooling and silencing system from the surroundings in such a manner that the mechanical vibrations produced during operation only affect the surroundings on a small scale.

Finally, the invention is also intended to achieve a satisfactory cooling of the medium which passes through the compressor or vacuum pump and to deaden the irritating noise which spreads to the surroundings through this medium.

To accomplish the above-listed objects, both the compressor and the driving motor are of the kind which can be immersed and are arranged in a totally sealed container which encases a cooling and sound-absorbing liquid to such a level that the compressor or vacuum pump and driving motor are totally immersed in the liquid, the whole of the outer surface of the container is coated with sound-absorbing material, and at least one heat exchanger is arranged outside the container and the sound-absorbing material, said heat exchanger being in communication with the inside of the container in such a manner that the cooling and sound-absorbing liquid flows through the heat exchanger under the influence of the thermal circulation generated in the liquid.

The invention has a wide scope of use and can be employed generally with all kinds of compressors or vacuum pumps. Suitable fields of application are compressors and vacuum pumps used in connection with the dental and medical professions and also for industrial purposes. The above-mentioned examples, however, must not be regarded in a limited sense.

DESCRIPTION OF THE DRAWING

A suitable form of construction of the invention is described in the following, taking consideration to the attached schematical drawing which, in vertical section, shows a compressor or vacuum pump and device for the cooling and silencing of same.

DETAILED DESCRIPTION

The device shown in the drawing comprises a compressor 1 or vacuum pump (hereinafter, for the sake of simplicity, referred to as compressor only) which is coupled directly to and is driven by an electric motor 2. The compressor 1 can be of the membrane, piston or rotor type. The compressor 1 together with the motor 2 are housed in a totally sealed water-tight container 3 of such form that the walls and lid are situated at a distance from the compressor and driving motor. The container 3 encases a cooling liquid 4 of suitable composition to a level 5 situated slightly below the lid of the container, so that a space 6, to receive expansion of the cooling liquid 4, is formed between the level of the liquid 5 and the lid.

The sidewalls, bottom and lid of the container are coated with a suitable sound-absorbing material 7 and are covered by an outer housing 8 which lies close against the sound-absorbing material 7.

The compressor 1 and the driving motor 2 are thus completely surrounded by the cooling liquid 4 and the heat produced during operation is transferred to the cooling liquid. The thereby heated portion of the cooling liquid rises upwards towards the liquid level 5 and a thermal circulation is thereby produced in the liquid pool.

The device according to the invention also comprises a heat exchanger 9 which is provided outside the outer housing 8. One or more inlet tubes 10 to the heat exchanger 9 extend in a fluid-tight manner through the outer housing 8, the sound-absorbing material 7 and the sidewalls of the liquid container 3 and are in open communication with the inside of the container 3 somewhat below the level 5 of the cooling liquid 4. One or more outlet tubes 11 from the heat exchanger 9 are in a similar manner drawn to the inside of the liquid container 3 and open into same immediately above the bottom of the container. Through the thermal circulation produced in the cooling liquid 4, a portion of the heated cooling liquid flows through the entrance tubes 10, passes through the heat exchanger 9, and thereby transfers heat to the ambient air, and finally, in cooled condition, is returned to the liquid container 3 by means of the outlet tubes 11. The cooling liquid in the container 3 is thereby kept within a suitable degree of temperature for cooling of the compressor 1 and the driving motor 2, and overheating of the cooling liquid is prevented. At the same time a large proportion of the heat produced when the compressor is in operation is regained and can be utilized, for example, for heating of the ambient air. If considered suitable, the heat exchanger 9 can be arranged in a casing (not shown) which, under self-circulation, leads the air upwards along the heat exchanger 9 in counter-flow against the downward streaming cooling liquid. If necessary, several heat exchangers 9 can, of course, be connected to the liquid container 3.

The cooling liquid 4, which surrounds the compressor 1 and the driving motor 2, and also the liquid container 3 with the sound-absorbing material 7 and outer housing 8, is not only intended to afford an effective cooling of the compressor 1 and the driving motor 2, but also brings about a very effective silencing of the noise which arises during operation. Water can be used as cooling liquid, but if an improved deadening of sound is desired, a liquid having greater sound deadening power, e.g. glycol, could be used.

The compressor 1 and the driving motor 2 are assembled as a unit and rest upon the bottom of the liquid container 3 over vibration reducing elements 12. The bottom of the liquid container 3 rests in its turn upon the bottom of the outer housing 8 over further vibration reducing elements 14. The mechanical vibrations on the floor in which the device is installed, which arise in the compressor 1 and driving motor 2, are thereby prevented or their transfer reduced.

The medium which shall be compressed and/or transported is fed to the compressor 1 through a pipe 15 which extends in a water-tight manner through the outer housing 8, the sound-absorbing material 7 and the one sidewall of the liquid container 3 and in the whole of its length up to the compressor 1 is immersed in the cooling liquid 4. After compression, the medium is directed out from the compressor 1 through an outlet pipe 16 which is likewise totally immersed in the cooling liquid 4 and passes out through the sidewall of the liquid container 3, the sound-absorbing material 7 and the outer housing 8. In order to increase the cooling of the medium, it can at least be of advantage to extend the outlet pipe 16 in the cooling liquid 4 by means of coils. To prevent the irritating noise from spreading through the medium flowing to and from the compressor 1, it is suitable that silencers 17 be connected to both the pipes 15 and 16, said silencers being also totally immersed in the cooling liquid 4. These silencers 17 should preferably be of the absorption kind so that loss of pressure does not arise. An absorption type siliencer as disclosed in U.S. Pat. No. 2,840,180 may be used. A filter 18 can also be connected to the pipes 15 and 16, whereby the filter is situated outside the outer housing 8.

The compressor 1 is, in the known manner, provided with a pressure-reducing safety valve 20 and this valve is attached to a further pipe 19 which chiefly has the same extension as the pipes 15 and 16, and possibly also includes a silencer 17*a*.

A very effective cooling of the compressor 1 and the driving motor 2 through self-circulation during operation is thus achieved by the device according to the invention, whereby the heat taken up from the compressor and motor to a great extent is regained and used in a suitable manner. At the same time a very effective deadening of sound is obtained, the compressor being practically silent during operation. The working capacity of the compressor and driving motor is also improved.

What I claim is:

1. Apparatus for cooling and silencing a pressure fluid device, such as a compressor or a pump, having inlet and outlet ports and which is driven by an electric motor, comprising (a) a sealed container (3) containing a chamber in which said pressure fluid device and said motor are arranged, the bottom, side and top walls of said container each including a layer (7) of sound-absorbing material;

(b) a quantity of cooling and sound-absorbing liquid (4) filling the space in said chamber to a level above that of said device and said motor, whereby the device and motor and completely immersed in the liquid;

(c) inlet and outlet pipes (15, 16) extending through a wall of said container and connected at one end with the inlet and outlet ports of said device for supplying fluid to, and for removing fluid from, said device, respectively;

(d) heat exchanger means (9) arranged externally of said container; and (e) input and outlet conduit means (10, 11) connecting said heat exchanger means with said chamber to permit the flow of liquid between said chamber and said heat exchanger means, thereby to modify the temperature of said liquid.

2. Apparatus as defined in claim 1, and further including resilient support means (12) for supporting the pressure fluid device and motor on said housing bottom wall.

3. Apparatus as defined in claim 1, and further including siliencer means (17) connected in series in at least one of said inlet and outlet pipes, said silencer means being arranged in said container chamber in submerged relation beneath the level of the liquid contained in said chamber.

4. Apparatus as defined in claim 3, wherein said pressure fluid device includes a pressure-reducing safety valve (20), and further including a safety valve pipe (19) connected at one end with said safety valve, said safety valve pipe extending through an opening contained in a side wall of said container and terminating externally thereof.

5. Apparatus as defined in claim 4, wherein said silencer means (17*a*) is also connected in series in said safety valve pipe.

* * * * *